United States Patent [19]

Rivkin et al.

[11] 4,441,680

[45] Apr. 10, 1984

[54] ANCHOR FOR A PERFORATED BOARD HANGER

[76] Inventors: Bernard Rivkin, 16287 Oak Creek Trail, Poway, Calif. 92064; Marshall W. Wolfe, 2744 Brookside St., Ontario, Calif. 91761

[21] Appl. No.: 408,153

[22] Filed: Aug. 16, 1982

[51] Int. Cl.[3] ..... A47B 96/06

[52] U.S. Cl. ..... 248/220.4; 248/510

[58] Field of Search ..... 248/220.3, 220.4, 221.1, 248/221.2, 510, 68 R

[56] References Cited

U.S. PATENT DOCUMENTS

| | | | |
|---|---|---|---|
| 2,859,008 | 11/1958 | Zimmer | 248/221.2 |
| 3,037,732 | 6/1962 | Roman | 248/221.2 |
| 3,091,423 | 5/1963 | Butterworth | 248/221.2 |
| 3,193,225 | 7/1965 | Terlinde | 248/221.2 |
| 3,227,412 | 1/1966 | Terlinde | 248/221.2 |
| 3,289,991 | 12/1966 | Kalahar | 248/221.2 |
| 3,739,919 | 6/1973 | Hochman | 248/221.2 |
| 4,108,408 | 8/1978 | Butti | 248/68 R |
| 4,304,382 | 12/1981 | Jelen | 248/221.1 |

*Primary Examiner*—J. Franklin Foss

*Attorney, Agent, or Firm*—Frank D. Gilliam

[57] ABSTRACT

An elongated member for the stabilizing and securing of perforated wall board hangers secured to a perforated wall board by at least one aperture therethrough. The elongated member is configured to embrace at least a portion of the shank of at least one perforated wall board hanger. Each end of the elongated member is barbed or configured to provide a locking relationship with an aperture in the perforated wall board.

7 Claims, 8 Drawing Figures

ANCHOR FOR A PERFORATED BOARD HANGER

BACKGROUND OF THE INVENTION

The present invention relates to elongated tab members for perforated support boards and particularly to tab members for releasably stabilizing and securing hangers generally employed on perforated support boards.

Article supporting racks are commonly provided by the use of relatively rigid sheets of hardboard or the like, perforated in a regular grid-like pattern of apertures so that supporting hangers in the form of hooks or brackets may be secured in various locations on the board by engaging an anchoring element of the hanger with a selected aperture in the board. Hangers for such use with perforated board take many different forms and shapes that are determined by the nature of the articles that are to be supported thereby. In a broad sense, all or most of such hangers embody a vertically extended body or shank with an articlesupport extending forwardly from the lower end of the body or shank or from some intermediate point spaced downwardly from the upper end of the body or shank, and at the upper end of the body or shank anchoring means in the form of an anchoring hook or offset is provided which may be inserted rearwardly through a selected aperture in the perforated board in a known and well understood manner.

When thusly mounted on a perforated board, the body or shank extends downward with respect to the interlocked or anchored upper end, and because the lower portion of the body or shank bears against the forward face of the board, the projecting support may serve to carry the weight of an article placed on such support.

Hangers of the aforesaid character are generally made from a single length of wire having a diameter just slightly less than the diameter of the apertures in the board and the anchoring means is formed by bending of the wire at one end, the support is formed by bending the wire into a hook-like or other suitable form at the opposite end of the wire, while the intermediate portion of the wire is left in a straight form to provide the body or shank of the hanger. Conventionally, this intermediate body or shank portion has a length somewhat greater than the vertical spacing of the apertures.

In the use of hangers made from a single piece of wire as above described, it has been found that when an article is put in place on or is removed from the hanger, the lower end of the hanger often shifts laterally across the forward face of the board, or forward away from the board. Such forward displacement of the lower portion of the hanger often disengages the hanger from the perforated wall board. Such undesired displacement of the hangers has been considered objectionable to such an extend that various forms of stabilizers have been provided for connecting the lower portion of the body or shank with the aperture that is located immediately below the aperture in which the upper end of the hanger is secured. In some instances, the stabilizing means has taken the form of projecting lugs integral with the body or shank of the hangers and adapted to extend into the lower aperture with a snug friction fit, while in other instances, separately formed, generally U-shaped fine wire clips have been provided to embrace the body or shank of the hanger, with the ends of the clips projected through the lower opening in the board and having a spring-like lateral engagement with the sides and rear edges of the aperture.

A search of the prior art uncovered the following U.S. Pat. Nos. directed to this art: 2,859,008; 2,961,724; 3,037,732; 3,037,733; and 3,069,122.

An entirely satisfactory means for both stabilizing and securing of perforated board hangers has not been available until the emergence of the present invention.

SUMMARY OF THE INVENTION

The present invention is concerned with both the stabilization and the securing of perforated board hangers through the use of a separately formed, elongated member that utilize one or more apertures of a perforated board, embraces at least the body or shank portion of at least one hanger and preferably up to three hangers and includes end portions adapted to be inserted into an aperture in the perforated board and be frictionally secured therein in a well known manner. The body or shank portion of the hanger is thereby held against the face of the perforated board to prevent the lower end thereof from inadvertently pivoting forwrd, thereby disengaging the upper hook portion from the perforated and also embracing the hanger so that the hanger cannot rotate laterally about its perforated boards engaged connection.

An object of this invention is to provide such a separately formed member by means of which the lower body or shank portion of the hanger may be positively held against forward and lateral displacement with respect to its normal location on the perforated board.

Still another object of this invention is to provide such a separately formed member that may readily and easily put in place in or removed from its operative location on the perforated board.

Still another object of this invention is to provide such a separately formed member that may be made economically by the molding of inexpensive plastic or the like.

A still further object of this invention is to provide such a member that is adaptable for use with all conventional pegboards and perforated boards.

Other and further objects of the present invention will be apparent from the following description and claims, and are illustrated in the accompanying drawings, which, by way of illustration, show a preferred embodiment of the present invention and the principles thereof, and what is now considered to be the best mode in which to apply these principles. Other and different embodiments of the invention embodying the same or equivalent principles may be used and structural changes may be made as desired by those skilled in the art without departing from the invention.

IN THE DRAWINGS

DETAILED DESCRIPTION OF THE DRAWINGS

Figures 1, 2, 3, 4, 5, 6, 7, 8:
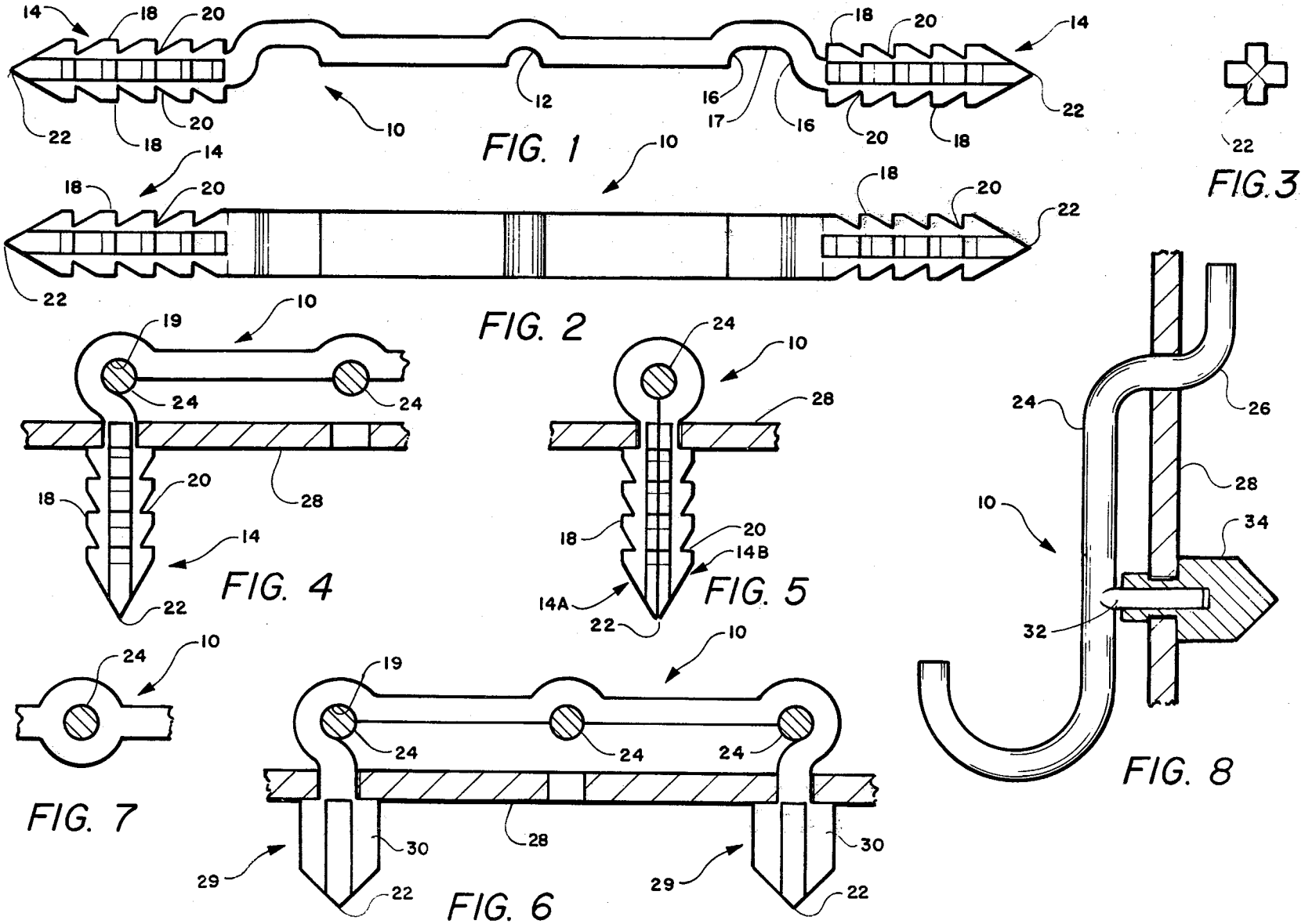
FIG. 1 depicts a side view of a first embodiment of the perforated board hanger anchor of the invention.
FIG. 2 depicts a plan view of the anchor of FIG. 1.
FIG. 3 depicts an end view of the anchor of FIG. 1.
FIG. 4 depicts a partial side view of the anchor of FIG. 1 with one end shown formed and inserted into a perforated board aperture.
FIG. 5 depicts a second embodiment of the pegboard hanger anchor for holding a single anchor in a single perforated board aperture.
FIG. 6 depicts a side view of a second anchor having a different end configuration inserted and locked into apertures of a perforated board shown cutaway anchoring three perforated board hangers in place.
FIG. 7 depicts a second configuration of the FIG. 1 embodiment wherein central hanger engagement.
FIG. 8 depicts a side view of a cutaway portion of a sheet of perforated board with a typical hanger secured in place by a slip-on anchor.

Referring now to the figures and particularly to FIGS. 1–4 wherein the reference numeral 10 generally denotes one embodiment of the perforated board hanger anchor of the instant invention. The anchor 10 is formed of a continuous length of a semi-pliable material such as semi-hard rubber or plastic. The anchor is formed with a central curvilinear portion 12 for embracing a perforated board hanger (see FIG. 4), an elongated offset combined curvilinear and straight offset portions 16 and 17 respectively on each side of the central curvalinear portion 12 and an end portion 14. The end portions 14 are formed in a serrated manner which include protrusions or barbs 18 with angular depressions 20 therebetween and a substantially pointed outer end tip 22. An end view of the anchor 10 is shown in FIG. 3.

FIG. 7 shows the central portion of the anchor formed with an aperture therethrough which surrounds the shank 24 of the perforated board hanger 14.

In the FIG. 4 showing, the end portion 14 of the anchor is forced to a position substantially 90° from its normal FIGS. 1 and 2 positions. The combined curvilinear and straight portions 16 and 17 respectively when forced as shown form a curvilinear portion 19 which is greater in circumference than the semi-circle formed at 12. As may be seen in FIGS. 4 and 6, the end portions 14 and 28 are aligned with the center of the curvilinear portion 19. This alignment feature enables the ends 14 to be inserted into standard spaced apertures in the perforated board and yet hold a hanger 24 inserted into a separate aperture on the same plane as the aperture which the ends 14 of hanger hook 24 are inserted. In the FIG. 5 showing, the ends of anchor 10 are folded to an adjacent position, thereby forming substantially an aperture for the shank 24 to be inserted. This configuration of the anchor provides means for securing a single perforated board hanger.

FIG. 6 depicts a side of an anchor 10 inserted at each end 29 into an aperture of the perforated board 28 (shown in cutaway) and three perforated board hanger hooks 24 held to the face of the board by one anchor. Further shown in FIG. 6 is a second embodiment of the locking configuration of the end of the anchor 10. In this configuration only a single protrusion or barb 30 is positioned at each quadrant of the end portion 14 is utilized. This configuration is formed for use when locking the anchor 10 into a specific and consistent thickness of the perforated board 28. In contrast, the anchor end 14 as shown in FIGS. 1–5 accommodates any thickness of perforated board 28 within its length from curvilinear portion 19 to tip 22. As can be understood, both end 14 and 29 are designed to penetrate into an aperture with ease and to resist removal therefrom.

FIG. 8 depicts a conventional pegboard hanger 24 installed on a perforated board with upper end 26 and protrusion 32 inserted through apertures through the perforated board 28 in a conventional manner with the hanger held in position by a slip on or molded tip 32, anchor 10 inserted onto the protrusion 34 prior to inserting through the aperture, thereby locking the hanger to the walls of the aperture of the perforated board.

It should now be apparent that the present invention provides a stabilizer and securing means for a conventional pegboard hanger that is positive in its retaining and stabilizing action, and yet may be forceably removed from the front of the pegboard for re-use without special tools. It will also be evident that the anchor of the present invention may be economically made by conventional forming means, and further, that this anchor may be advantageously employed with substantially all of the different conventional pegboards.

Thus, while a preferred embodiment of the invention has been illustrated herein, it is to be understood that changes and variations may be made by those skilled in the art without departing from the spirit and scope of appending claims.

What is claimed is:

1. An anchor for stabilizing and securing perforated board hangers in apertures in a board having a plurality of apertures therethrough positioned in a spaced apart relationship, said perforated hangers include an upright shank with at least one integral offset hook for insertion through at least one of said plurality of apertures for securing thereto, comprising an elongated stabilizing member spanning across the surface remote from said perforated board and formed to at least partially surround the shank of at least one hanger, whereby the shank of said hanger is held in place vertically adjacent to the surface of said board.

2. The invention as defined in claim 1 wherein said means for surrounding a portion of at least one hanger is curvilinear and surrounds the outer surface of the hanger remote from said board.

3. The invention as defined in claim 2 wherein said curvilinear portion is at least semi-circular.

4. The invention as defined in claims 1, or 3 wherein said perforated board hangers number three.

5. The invention as defined in claim 1 wherein the ends of said elongated stabilizing member have a plurality of barbs positioned therealong and therearound in a manner for easily insertion and to resist removal from its locking engagement with said aperture.

6. The invention as defined in claim 1 wherein said elongated stabilizing member is configured to secure the shank of a perforated board hanger adjacent each end thereof and intermediated said ends thereof.

7. The invention as defined in claim 1 wherein said anchor folds about the shank of a single hanger whereby in its folded together condition the distal ends of said anchor are insertable into a single aperture through said board thereby holding said hanger in a selected vertical position.

* * * * *